United States Patent [19]

Raczkowski

[11] Patent Number: 4,805,804

[45] Date of Patent: Feb. 21, 1989

[54] POTTED PLANT FEEDER

[76] Inventor: Romuald Raczkowski, 4902 N. Lawndale, Chicago, Ill. 60625

[21] Appl. No.: 82,310

[22] Filed: Aug. 6, 1987

[51] Int. Cl.[4] ..... F04B 19/24; B67D 5/08

[52] U.S. Cl. ..... 222/54; 222/146.5; 417/207; 219/312

[58] Field of Search ..... 222/52, 54, 146.2, 146.5, 222/330, 372, 405, 482, 491; 219/312; 417/207–209

[56] References Cited

U.S. PATENT DOCUMENTS

| | | | |
|---|---|---|---|
| 3,065,712 | 11/1962 | Buchanan et al. | 417/209 |
| 3,087,438 | 4/1963 | Ciesielski | 417/207 |
| 3,437,241 | 4/1969 | Pei | 222/650 |
| 3,969,605 | 7/1976 | Danell | 219/208 |
| 4,062,491 | 12/1977 | Von Skwarski | 239/66 |
| 4,212,593 | 7/1980 | Chadwick | 417/53 |
| 4,304,528 | 12/1981 | Jordan | 417/208 |

FOREIGN PATENT DOCUMENTS 2540850 8/1984 France .

*Primary Examiner*—Michael S. Huppert
*Attorney, Agent, or Firm*—Paul H. Gallagher

[57] ABSTRACT

A water container has an inlet water line and an outlet water line, each with a one-way check valve therein. An electric heater element heats the water, controlled by a thermo switch that senses the temperature of the water. The switch is set to turn on at a low temperature of the water and turn off at a high temperature thereof. Upon heating and expanding of the water, it is forced out through the outlet water line to the cut plants, and upon cooling and contraction of the water, replenishment water is drawn in through the inlet water line.

1 Claim, 1 Drawing Sheet

POTTED PLANT FEEDER

FIELD OF THE INVENTION

The invention resides in the field of feeding or watering potted plants.

OBJECTS OF THE INVENTION

A broad object of the invention is to provide novel apparatus and method for feeding or watering cut plants, for a period of time, in an automatic manner, without the requirement for personal attention.

Another object is to provide such apparatus and method specially adapted to small scale operation, such as in a home.

An additional and more specific object is to provide apparatus and method utilizing a heat-change step, and consequent expansion and contraction of the water in a container, for controlling the amount of water applied to the plants and the periods of time in which t is so applied.

DESCRIPTION OF A PREFERRED EMBODIMENT:

The apparatus of the invention will find most usefulness in watering potted plants. Water itself may be considered as plant food, and it is also intended that plant foods, other than water, may be incorporated in the water and applied to the plants. Accordingly, the generic term water is used herein for convenience to include all kinds of plant foods.

Figure 1:
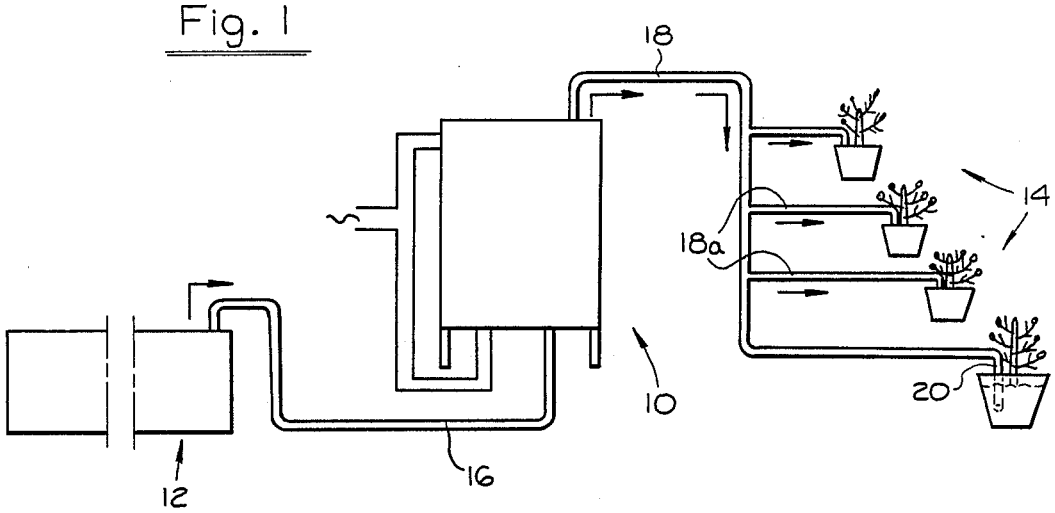
FIG. 1 is a semi-diagrammatic view of the apparatus of the present invention in association with a source of water and a series of potted plants.
Figure 2:
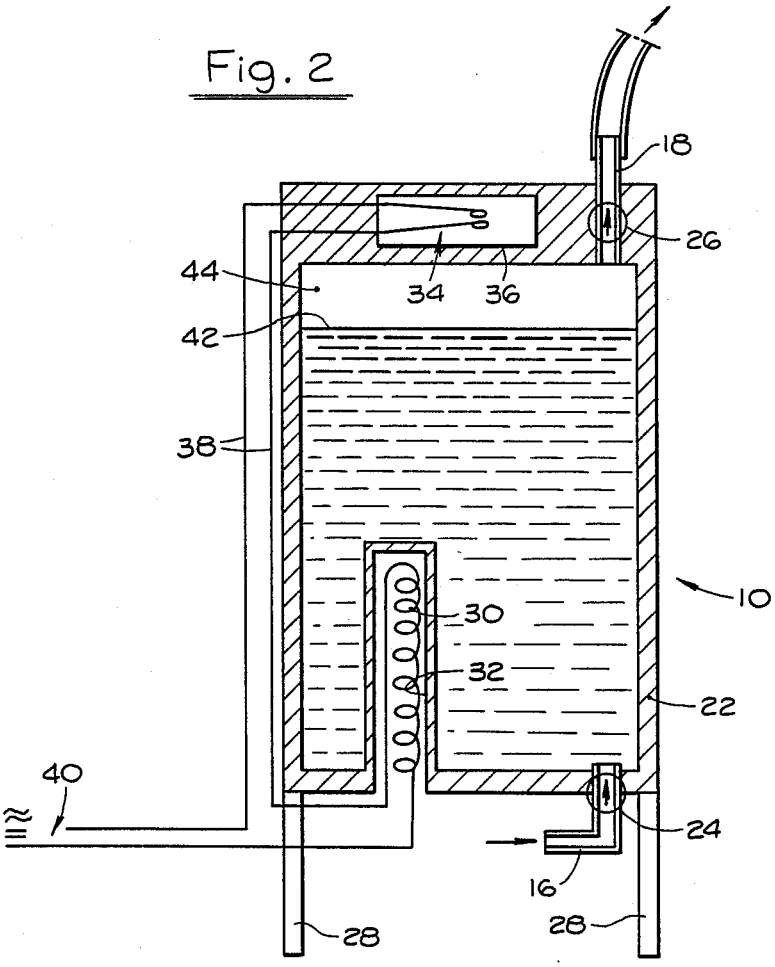
FIG. 2 is a vertical sectional view of the apparatus.

Referring in detail to the drawings, the apparatus of the invention is indicated at 10, and in FIG. 1 it is shown associated with other components indicated diagrammatically, including a source of water 12 and a plurality of potted plants 14. In the operation of the apparatus, water is drawn in from the water source 12 through an inlet water line 16 and it is expelled through an outlet water line 18 which has a plurality of branches 18*a*, leading to respective ones of the potted plants 14. If desired the branches 18*a* may be provided with terminal spouts 20 which are inserted in the soil in the pots holding the plants, although such spouts are not necessary.

The apparatus 10, which may also be referred to as a unit for convenience, includes a container 22 which is sealed except for the inlet line 16 and outlet line 18. The container may be of any desired material, but as referred to hereinbelow, a heat insulation factor may be considered.

The inlet water line 16 includes a one-way check valve 24 therein, and the outlet water line 18 includes a one-way check valve 26.

The unit 10 may be provided with legs 28 for supporting it at a suitable height relative to the water source 12, the bottom of the container 22 being at least as high as the top of the water in the source 12, so as to provide flow of water into the container 22 by atmospheric pressure, as contrasted with gravity acting on the water in the water source.

An electric heating element 30 is positioned in a cell formed in a tubular element 32, and thereby sealed against the water in the container, for heating the water.

A thermo switch 34 of known kind is incorporated in the container in position for sensing the temperature of the water. This sensing step may be as desired, such as through an element 36 in the construction of the container.

Conductors 38 interconnect the heating element 30 and switch 34 with a suitable electrical source indicated generally at 40.

As noted above, the switch 34 is of known kind, and in the present case if of such character that it automatically closes or turns on at a predetermined lower temperature and opens or turns off at a predetermined upper temperature. Such lower and upper temperatures in the present case are predetermined as 90° F. and 160° F., but it will be understood that these are only examples and the invention is not limited to these specific temperatures. As is obvious, the water in the container is heated by the element 30, and when the water reaches its desired upper temperature, the switch turns off and the heater element cools, and the water cools.

Normally the container is nearly full of water, although the level will drop a very small amount from the top of the container, because of a vacuum in the container, as referred to hereinbelow. The level is indicated at 42, and the space above the water is indicated at 44.

In the operation of the unit 10, a starting point is assumed at which the switch 34 has just been turned off. At this point the container is theoretically full, and the water therein is at its highest temperature, 160° F. As the water thereupon cools, it contracts, and because the one-way check valve 26 is held closed, a rarefied air condition develops in the space 44 above the water. This rarefied air condition, or partial vacuum, will be referred to as a vacuum for convenience. Although the weight of the water tends to hold the one-way check valve 24 closed, the vacuum lifts the water from source 12 through the inlet water line and through the valve 24 therein into the container. This lifting of the water into the container as just referred to, tends to nullify the vacuum, but a certain balance is reached, as between the vacuum and the weight of the water, establishing the water level 42 as noted.

As water in the tank continues to cool, water is continually drawn in through the inlet line 16, and when the temperature of the water reaches the lower point indicated, 90° F., the switch 34 closes and turns on the electric heater 30 and heats the water. The water thus expands and holds the valve 24 closed, and it is forced out through the outlet line 18 to the plants.

This heating/cooling cycle is repeated, and in each cycle a predetermined quantity of water is delivered to the plants. This quantity of water, and the frequency of transmitting the water, are determined by several factors. The size of the container of course is a principal factor in determining the quantity of water, a larger container providing a larger quantity of water in a cycle. However, the larger the quantity that is utilized, the greater will be the quantity of heat applied to the water during the heating step in what may be referred to as a normal cycle. The material of which the container is made, will determine the speed of cooling of the water; the container may be made simply of steel, having great conductivity of heat and low insulation, while if it is desired to have a slow cycle, the container may be made of high heat insulation material. The quantity of water to be handled, or the load to be provided, will be determined at least in part by the number and size of the plants to be watered. The spacing of the cycles may be different in different circumstances, such as to provide a long cycle, a short cycle, etc., depending upon the kinds of plants to be accommodated. Additionally, the length of the cycle may be determined in part by the size of the heater element.

The apparatus is well adapted to various specific kinds of uses. For example, it is very convenient to set it up and use in the home, since it can be of small size and the water source 12 may be any practical kind of container, having the capacity for holding enough water for a given period of time, such as one week, two weeks, etc. Also, as noted above, the source of water 12 is at a low point, not higher than the bottom of the container so that the water is supplied to the container only by atmospheric pressure and not by gravity.

I claim:

1. A potted plant feeder comprising, a container, means for providing a source of water at atmospheric pressure at a level no higher than the bottom of the container, an inlet water line leading from the water source to the container at the bottom of the container, a first one-way valve in the inlet water line, an outlet water line leading from the container at the top of the container to a plant, a second one-way valve in the outlet water line, the container including means forming a cell at the bottom of the container sealed to the interior of the container and open to the exterior, an electrical heating element in said cell in heat transfer relation to water in the container, the container having a space in the construction thereof at the top of the container and a thermo switch in said space in heat sensing relation to water in the container, the thermo switch being operable for closing at a predetermined lower temperature of the water and opening at a predetermined higher temperature of the water, and electrical circuitry interconnecting the thermo switch and heating element with an electrical source and the thermo switch being thereby operable for energizing and de-energizing the heating element respectively at said lower and higher temperatures, and consequently heating the water and enabling it to cool, respectively, whereby the water when heated holds the first one-way valve closed and forces the second one-way valve open, and thereby forces a portion of itself through the outlet water line.

* * * * *